US006174195B1

(12) United States Patent
Yang

(10) Patent No.: US 6,174,195 B1
(45) Date of Patent: Jan. 16, 2001

(54) RIBBON CABLE CONNECTOR WITH UNITARY CONDUCTIVE MEMBERS FOR CONNECTING RESPECTIVELY AND ELECTRICITY SELECTED SIGNAL TERMINALS TO A GROUNDING PLATE

(75) Inventor: Sheng-Ho Yang, Taipei Hsien (TW)

(73) Assignee: Advanced Connectek Inc., Taipei Hsien (TW)

( * ) Notice: Under 35 U.S.C. 154(b), the term of this patent shall be extended for 0 days.

(21) Appl. No.: 09/385,043

(22) Filed: Aug. 30, 1999

(30) Foreign Application Priority Data

Oct. 1, 1998 (TW) ..... 87216305

(51) Int. Cl.[7] ..... H01R 12/24
(52) U.S. Cl. ..... 439/497; 439/404
(58) Field of Search ..... 439/497, 404, 439/405, 492, 494, 395, 417

(56) References Cited

U.S. PATENT DOCUMENTS 4,781,620 * 11/1988 Tengler et al. ..... 439/497
5,820,403 * 10/1998 Cheng et al. ..... 439/404
5,902,147 * 5/1999 Jochen et al. ..... 439/497
5,967,832 * 10/1999 Ploehn ..... 439/497

* cited by examiner

*Primary Examiner*—Paula Bradley
*Assistant Examiner*—Tho D. Ta
(74) *Attorney, Agent, or Firm*—Liniak, Berenato, Lonagacre & White

(57) ABSTRACT

A ribbon cable connector is adapted to establish electrical connection with a ribbon cable, and includes an elongated terminal seat and an elongated clamping frame, which is removably connected to the terminal seat and which is adapted to clamp the ribbon cable between the terminal seat and the clamping frame. A ground terminal set includes a grounding plate positioned on the terminal seat, and a longitudinal row of ground terminals, which are formed integrally with the grounding plate. Two longitudinal rows of signal terminals are positioned on the terminal seat, and are located on two sides of the row of ground terminals. A number of positioning devices are disposed between the grounding plate and some of the signal terminals. A plurality of unitary conductive members are interposed between the grounding plate and the signal terminals. Each of the conductive members is placed within a selected one of the positioning devices, and is in electrical contact with the grounding plate and the corresponding signal terminal.

3 Claims, 8 Drawing Sheets

RIBBON CABLE CONNECTOR WITH UNITARY CONDUCTIVE MEMBERS FOR CONNECTING RESPECTIVELY AND ELECTRICITY SELECTED SIGNAL TERMINALS TO A GROUNDING PLATE

BACKGROUND OF THE INVENTION

1. Field of the Invention

This invention relates to a ribbon cable connector, more particularly to a ribbon cable connector, which has a plurality of unitary conductive members, each of the conductive members being capable of being placed between a grounding plate and a row of signal terminals for connecting the grounding plate electrically to a selected one of signal terminals.

2. Description of the Related Art

Referring to FIG. 1, a conventional ribbon cable connector 10 is shown to include an elongated terminal seat (10*a*) and an elongated clamping frame (10*b*), which are interconnected detachably by means of two snap fitting units (F). The clamping frame (10*b*) has a slotted clamping surface 101. The connector 10 is adapted to establish electrical connection with a ribbon cable (not shown) that is clamped between the terminal seat (10*a*) and the clamping frame (10*b*) and that includes a plurality of individually insulated parallel conductors. Some of the conductors are grounding conductors. The connector 10 further includes two ground terminal sets. As shown in FIGS. 2 and 2A, each of the ground terminal sets includes a grounding plate unit 11 and two rows of ground terminals 12, which are formed integrally with the grounding plate unit 11. The grounding plate unit 11 has a grounding plate 111, a plurality of notches 113, and a plurality of pressed contact legs 114, which are inclined relative to the grounding plate unit 11 and which are in electrical contact with a plurality of signal terminals (not shown), respectively. The pressed contact legs 114 are difficult to manufacture, and may bend or even break.

Referring to FIGS. 1, 2 and 2A, because only some of the signal terminals need to be connected electrically with the ground terminals, the contact legs 114 are formed on some predetermined positions on the grounding plate 111, which are decided according to the pattern of a printed circuit (not shown) that is connected electrically with the contact legs 114, thereby increasing the necessity of high precision when manufacturing the grounding plate unit 11. In assembly, when the clamping frame (10*b*) is moved toward the terminal seat (10*a*) to clamp the grounding plate unit 11, the ground terminals 12, and the ribbon cable (not shown) between the clamping frame (10*b*) and the terminal seat (10*a*) such that the terminals 12 piece through insulation of the ribbon cable (not shown), because there is no support for the ground terminals 12 and the ribbon cable (not shown), the ground terminals 12 deform to an extent that results in poor electrical contact between the ground terminals 12 and the ribbon cable (not shown) and in varying orientation of the contact legs 114. Variation in orientation of the contact legs 114 results in poor electrical contact thereof with the signal terminals (not shown).

SUMMARY OF THE INVENTION

An object of this invention is to provide a ribbon cable connector which requires a lower manufacturing precision.

Another object of this invention is to provide a ribbon cable connector with means for positioning firmly ground terminals between a conductive grounding plate and a ribbon cable, thereby ensuring good electrical contact between the ribbon cable and the ground terminals.

According to this invention, a ribbon cable connector is adapted to establish electrical connection with a ribbon cable, and includes an elongated terminal seat and an elongated clamping frame, which is removably connected to the terminal seat and which is adapted to clamp the ribbon cable between the terminal seat and the clamping frame. A ground terminal set includes a grounding plate positioned on the terminal seat, and a longitudinal row of ground terminals, which are formed integrally with the grounding plate. Two longitudinal rows of signal terminals are positioned on the terminal seat, and are located on two sides of the row of ground terminals. A number of positioning devices are disposed between the grounding plate and some of the signal terminals. A plurality of unitary conductive members are interposed between the grounding plate and the signal terminals. Each of the conductive members is placed within a selected one of the positioning devices, and is in electrical contact with the grounding plate and the corresponding signal terminal.

In one embodiment, each of the ground terminals is generally Y-shaped, and has two prongs, which are adapted to be in electrical contact with the ribbon cable and which are offset from each other in a transverse direction of the terminal seat. The terminal seat has a top surface that is formed with two integral longitudinal ribs. The grounding plate of the ground terminal set is disposed between the ribs. The two prongs of each of the ground terminals are supported respectively on the ribs to position the ground terminals on the terminal seat. A positioning seat is adapted to be clamped between the ribbon cable and the terminal seat, and has two outer longitudinal slots and two inner longitudinal slots that are located between the outer longitudinal slots. The inner and outer longitudinal slots are formed through the positioning seat, and are closed at ends thereof. The two prongs of each of the ground terminals extend respectively through the inner longitudinal slots in the positioning seat. The two longitudinal rows of the signal terminals extend respectively through the outer longitudinal slots in the positioning seat.

Preferably, each of the conductive members has a planar plate, a pressed short contact leg, and a curved long contact leg, which project respectively from two sides of the planar plate to connect electrically with the grounding plate and one of said signal terminals, respectively. Each of the signal terminals is formed with a curved integral contact leg, on which the curved long contact leg of the corresponding conductive member presses.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
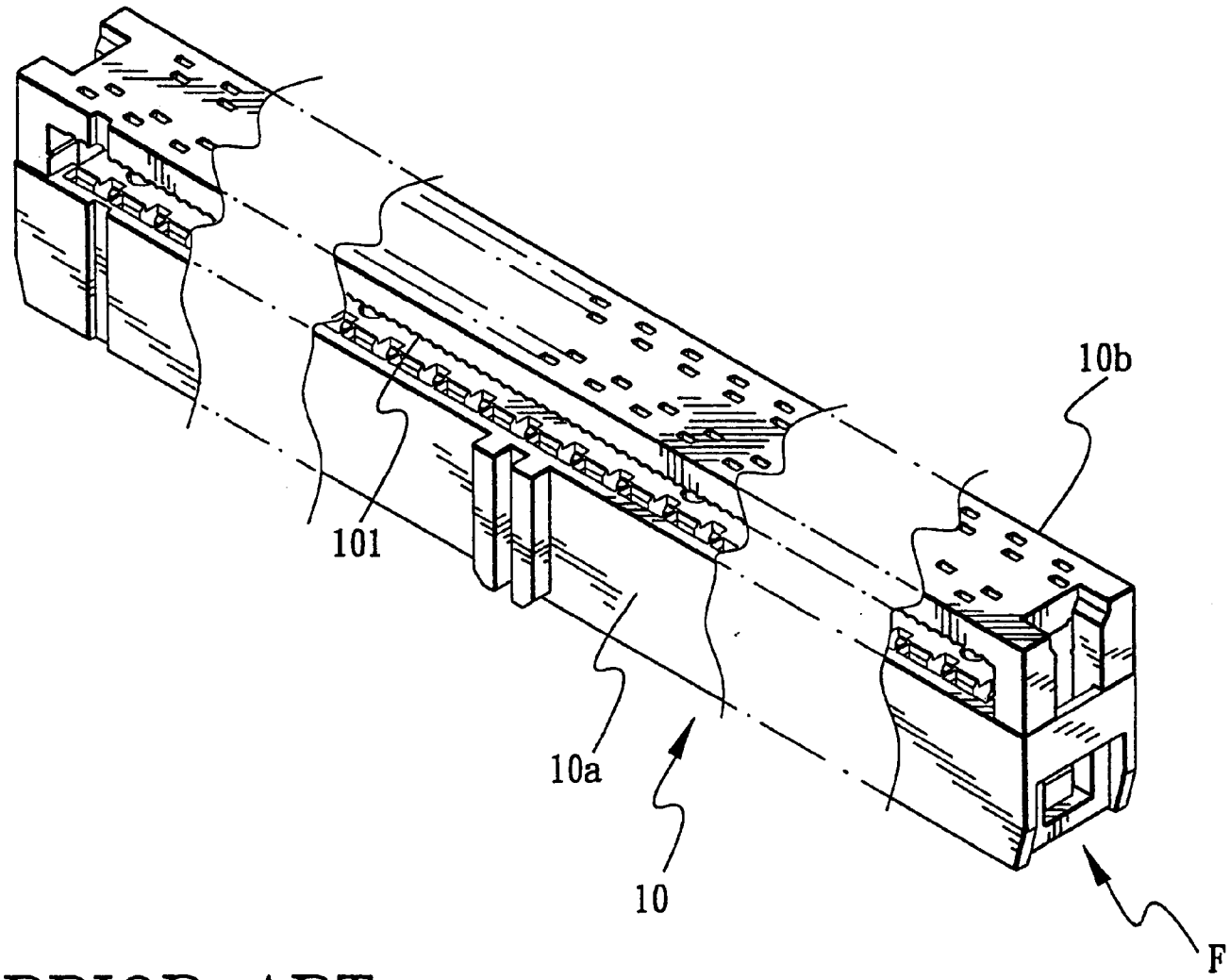
FIG. 1 PRIOR ART
FIG. 1 is an assembled perspective view of a conventional ribbon cable connector.
Figure 2A:
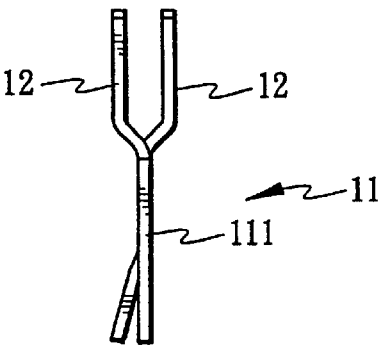
PRIOR ART FIG.2A
FIG. 2A is a side view of a ground terminal of the ground terminal set of the conventional cable connector.
Figure 2:
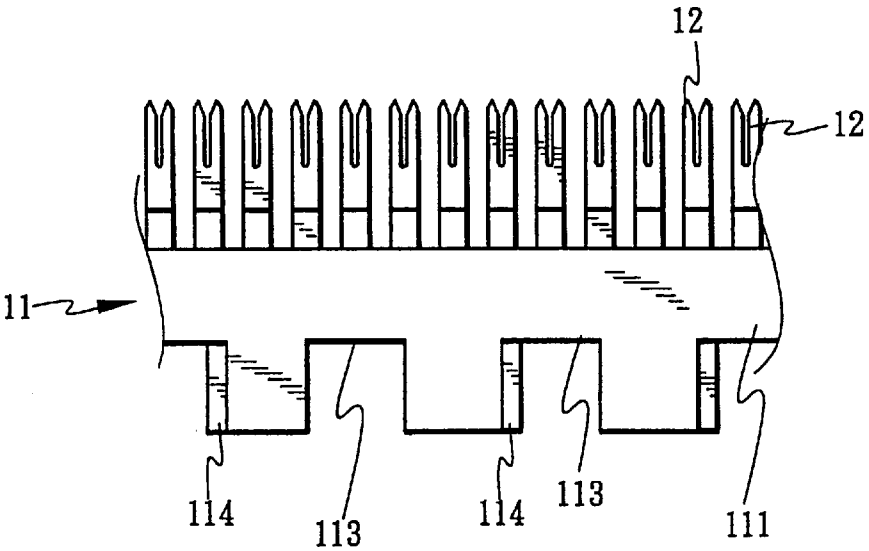
FIG.2 PRIOR ART
FIG. 2 is a fragmentary front view of a ground terminal set of the conventional ribbon cable connector.
Figure 3:
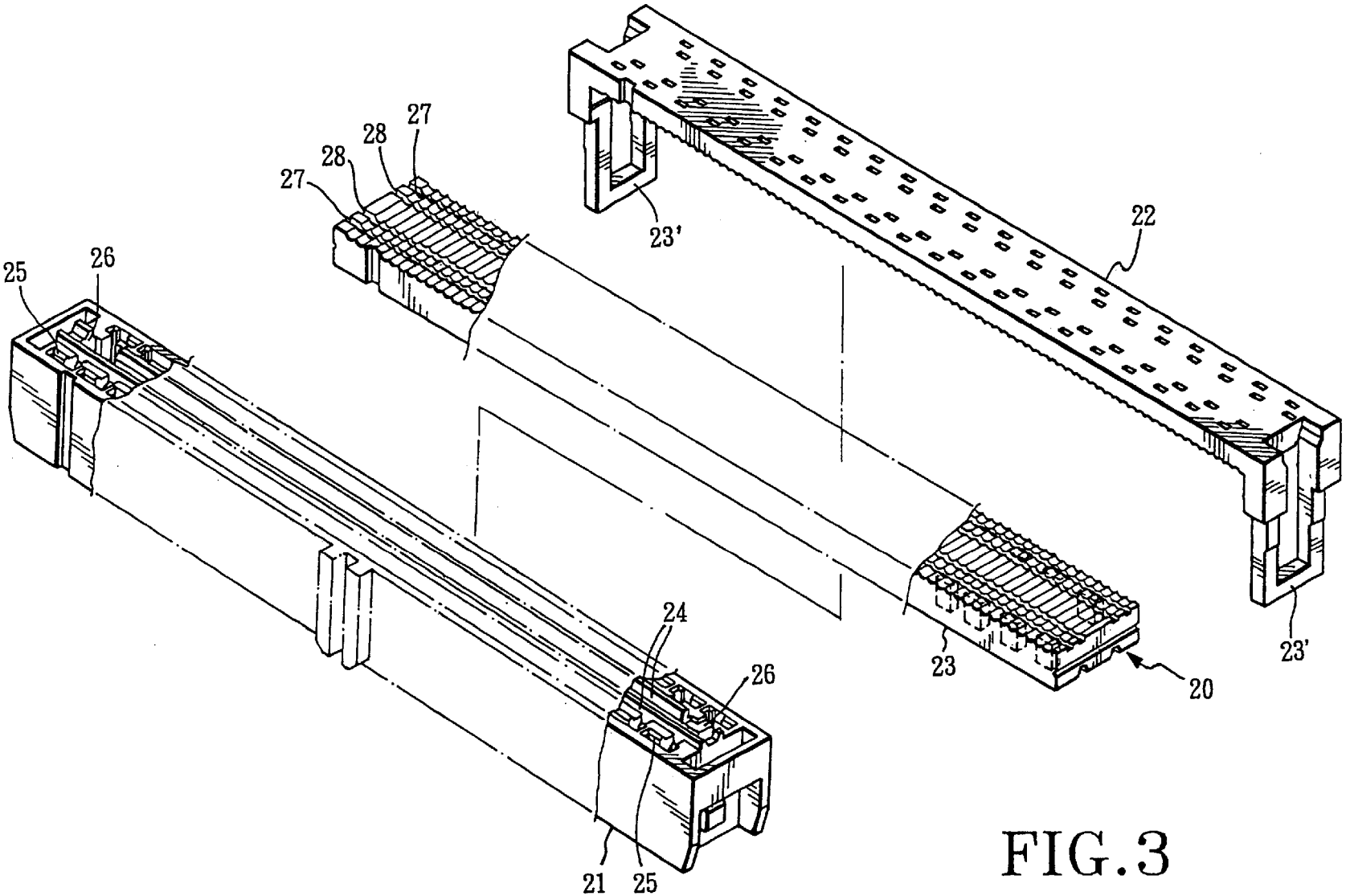
FIG. 3 is an exploded perspective view of the preferred embodiment of a ribbon cable connector according to this invention.

Referring to FIG. 3, the preferred embodiment of a ribbon cable connector 20 according to this invention is shown to include an elongated terminal seat 21, an elongated clamping frame 22, and an elongated positioning seat 23. The clamping frame 22 is removably mounted on the terminal seat 21 by means of two snap fitting units 23' in a known manner.

Figure 4:
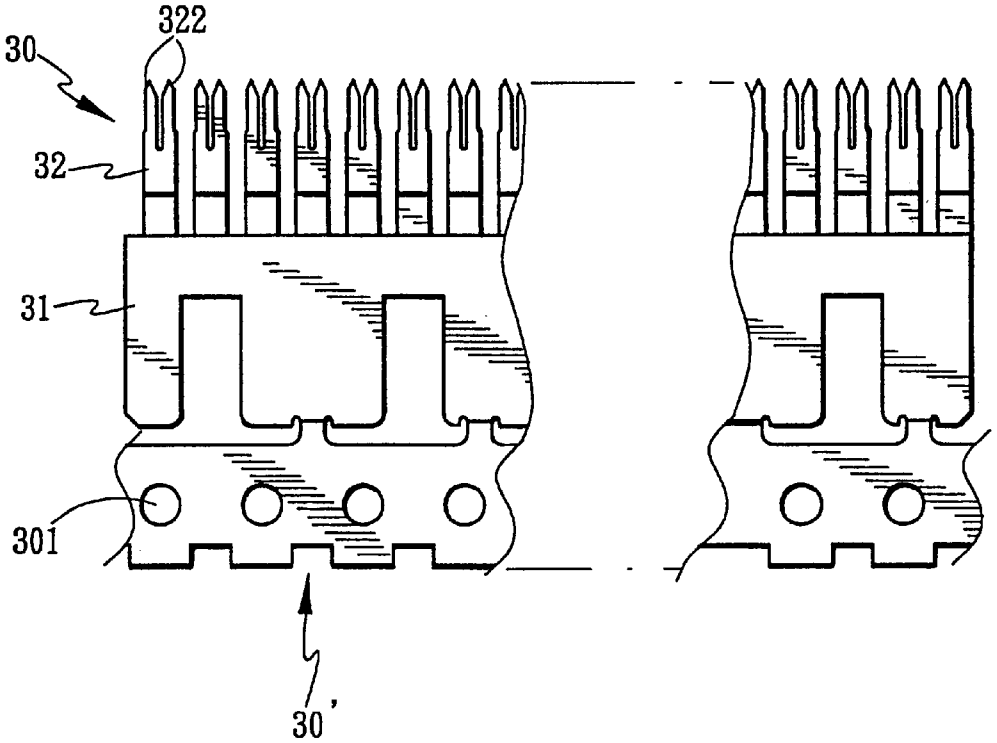
FIG. 4 is a fragmentary front view of a ground terminal set of the preferred embodiment, which is formed integrally on a carrier that is formed with a row of circular holes and that is removed from the ground terminal set when the ground terminal set is in use.

Referring to FIG. 4, the ribbon cable connector includes a ground terminal set 30 which is formed integrally on a carrier 30' that is formed with a row of circular holes 301 and that is removed from the ground terminal set 30 when the ground terminal set 30 is in use. The ground terminal set 30 consists of a grounding plate 31 and a row of ground terminals 32, which are formed integrally with the grounding plate 31.

Figure 4A:
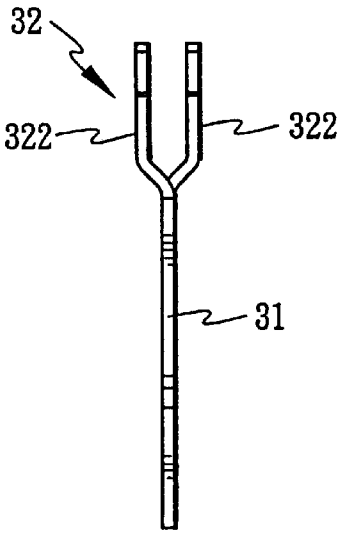
FIG. 4A is a side view of a ground terminal of the ground terminal set of the preferred embodiment.

Referring to FIG. 4A, each of the ground terminals 32 is generally Y-shaped, and has two prongs 322, which are adapted to be in electrical contact with a ribbon cable (not shown) and which are offset from each other in a transverse direction of the terminal seat 21.

Figure 5:
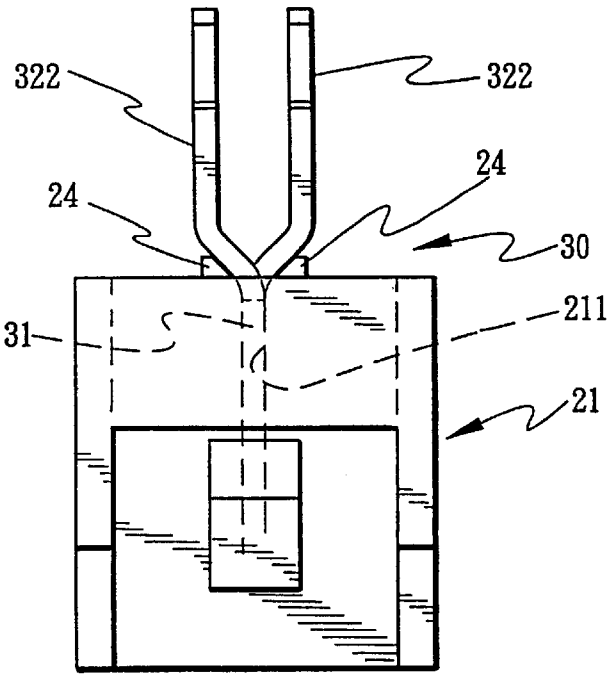
FIG. 5 is a schematic side view illustrating how the ground terminal set is supported by two ribs of a terminal seat of the preferred embodiment.

Referring to FIG. 5, the terminal seat 21 has a top surface, which has a positioning hole 211 for receiving the grounding plate 31 therein, and which is formed with two integral longitudinal ribs 24 (see FIG. 3) that define the positioning hole 211 therebetween. The grounding plate 31 is disposed between the ribs 24. The two prongs 322 of each of the ground terminals 32 are supported respectively on the ribs 24 to position the ground terminals 32 on the terminal seat 21.

Figure 6:
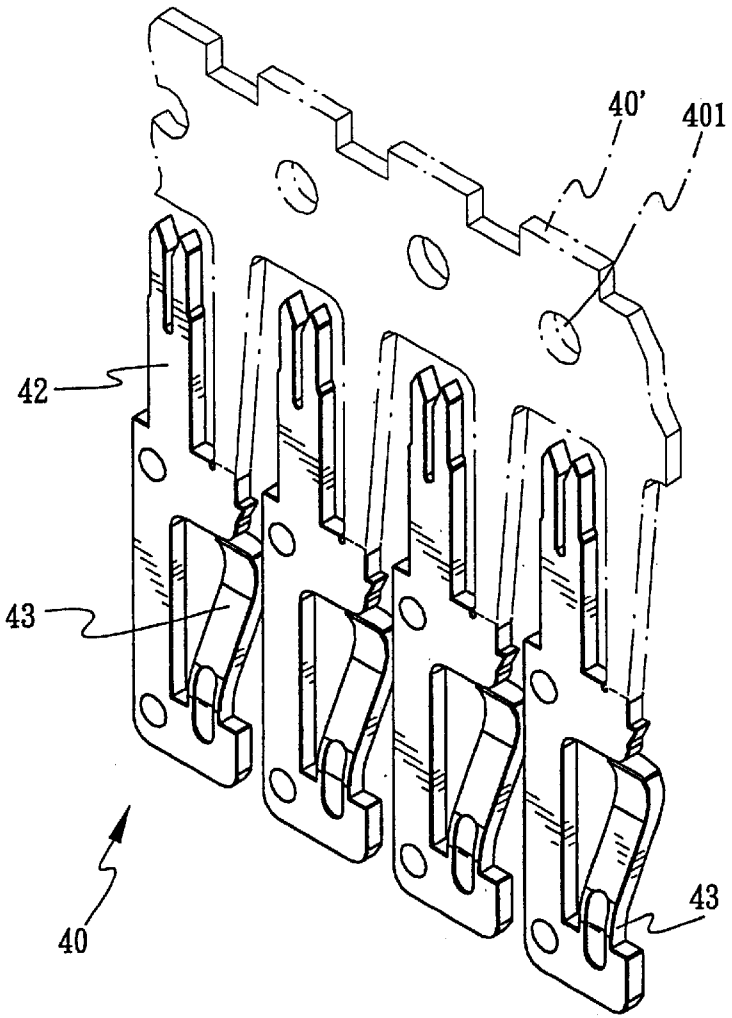
FIG. 6 is a front view of a plurality of signal terminals of the preferred embodiment, which are formed integrally on a carrier that is formed with a row of circular holes and that is removed from the signal terminals when the signal terminals are in use.
Figure 7:
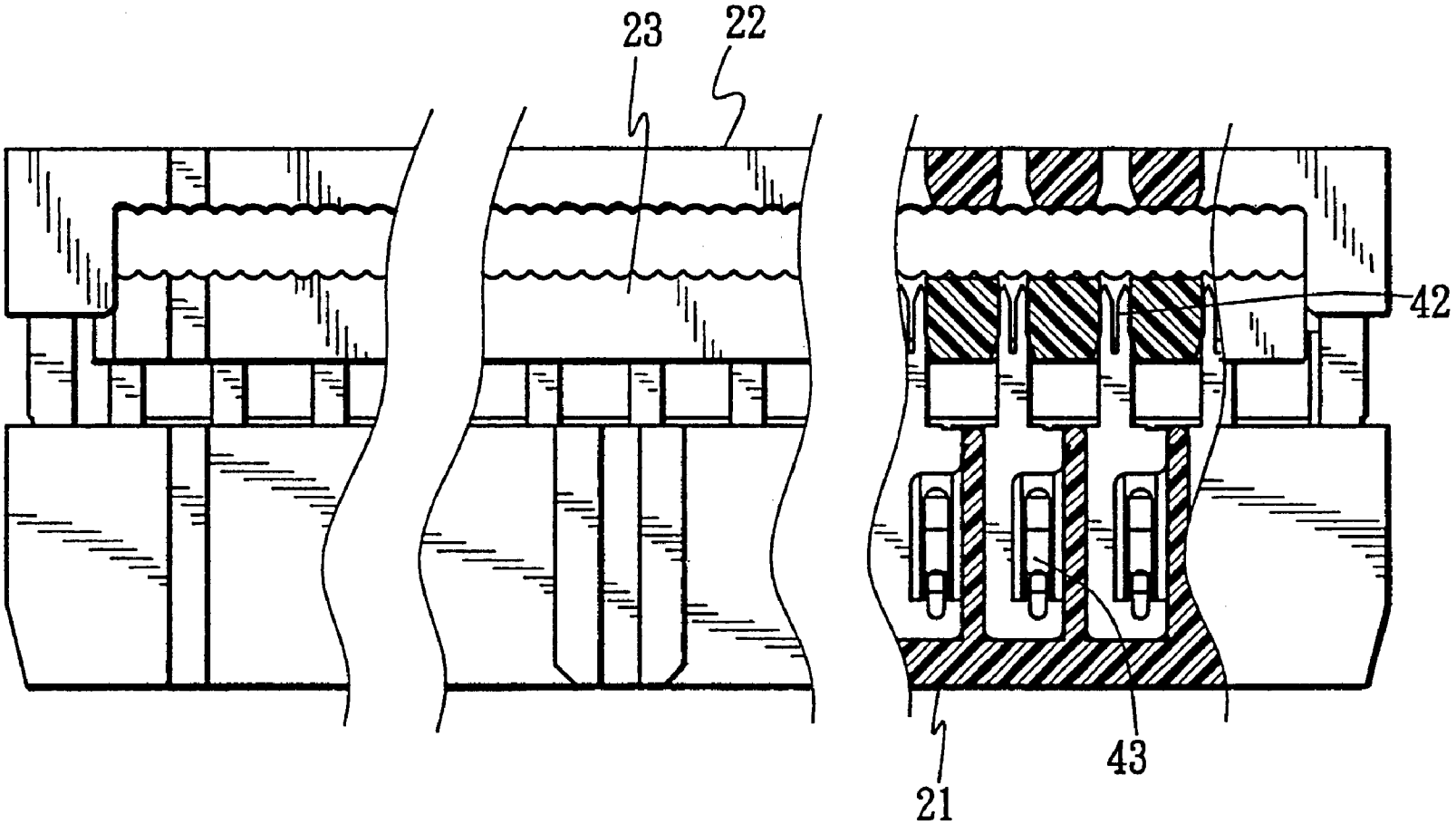
FIG. 7 is a partly sectional front view illustrating how the signal terminals are mounted on the terminal seat and a positioning seat of the preferred embodiment.

Referring to FIG. 6, the ribbon cable connector further includes a signal terminal unit 40, which is formed integrally on a carrier 40' that has a row of circular holes 401 and that is removed from the signal terminal unit 40 when the signal terminal unit 40 is in use. The signal terminal unit 40 consists of a plurality of signal terminals 42, each of which is formed integrally with a curved contact leg 43. As shown in FIG. 7, the signal terminals 42 are disposed respectively within a plurality of positioning holes 25 (see FIG. 3) in the terminal seat 21 in a known manner.

Figure 8:
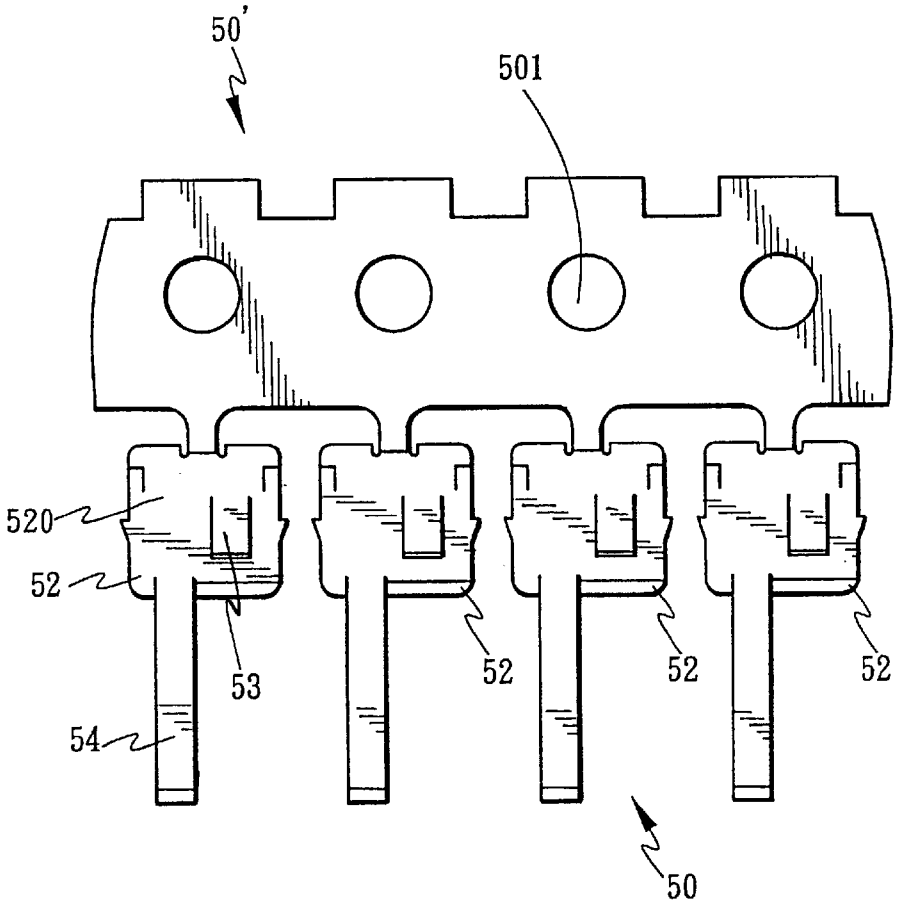
FIG. 8 is a front view of a plurality of unitary conductive members of the preferred embodiment, which are formed integrally on a carrier that is formed with a row of circular holes and that is removed from the conductive members when the conductive members in use.

Referring to FIG. 8, the ribbon cable connector further includes a connecting unit 50, which is formed integrally on a carrier 50' that has a row of circular holes 501 and that is removed from the connecting unit 50 when the connecting unit 50 is in use. The connecting unit 50 consists of a plurality of unitary conductive members 52.

Figure 8A:
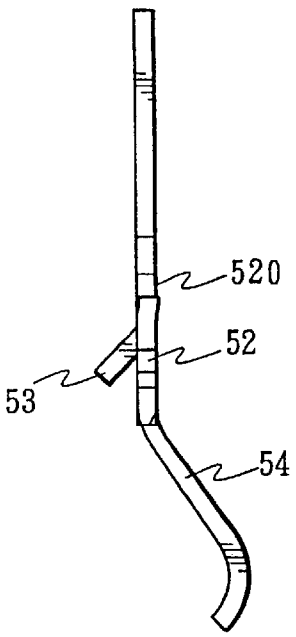
FIG. 8A is a side view of one of the conductive members of the preferred embodiment.

Referring to FIGS. 8 and 8A, each of the conductive members 52 has a planar plate 520, a pressed short contact leg 53, and a curved long contact leg 54, which project respectively from two sides of the planar plate 520. Each of the short contact legs 53 extends obliquely from the corresponding planar plate 520.

Figure 9:
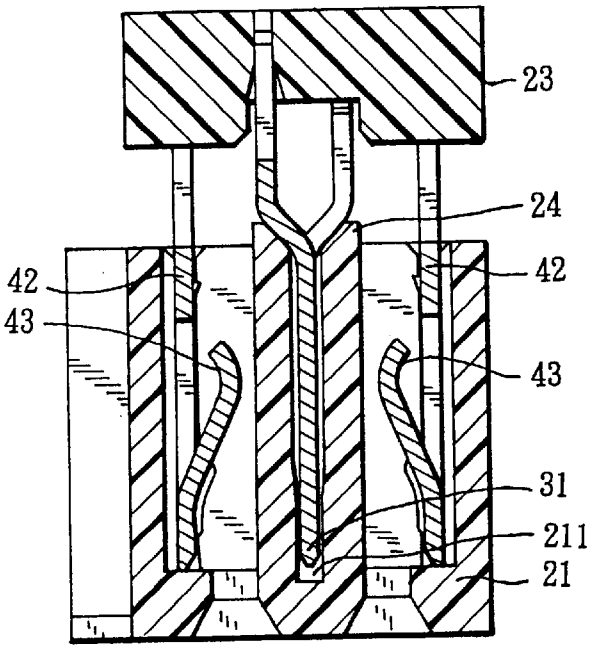
FIG. 9 is a schematic cross-sectional view illustrating the relationship between one ground terminal and two signal terminals, which are aligned with the ground terminal in a transverse direction of the terminal seat of the preferred embodiment.

Referring to FIG. 9, the grounding plate 31 is located between two longitudinal rows of the signal terminals 42. The curved contact legs 43 of the signal terminals 42 project toward the grounding plate 31.

Referring to FIG. 3, a number of positioning devices or cut-out portions 26 are formed in the ribs 24, and are communicated respectively with some of the positioning holes 25, in which the signal terminal 42 are disposed. The positioning seat 23 is adapted to be clamped between the ribbon cable (not shown) and the terminal seat 21, and has two outer longitudinal slots 27 and two inner longitudinal slots 28 that are located between the outer longitudinal slots 27. The inner and outer longitudinal slots 27, 28 are formed through the positioning seat 23, and are closed at ends thereof.

Figure 10:
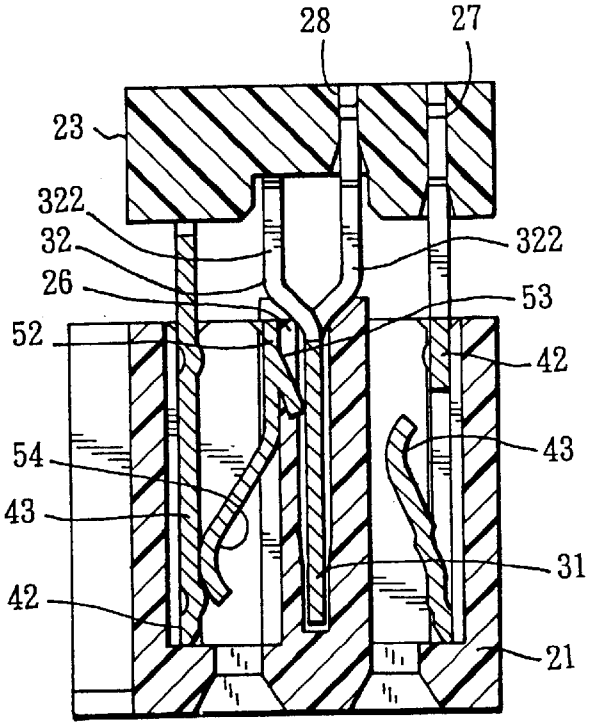
FIG. 10 is a schematic cross-sectional view illustrating how one of the ground terminals is connected electrically with one of the signal terminals of the preferred embodiment by means of one of the conductive members.

Referring to FIG. 10, each of the conductive members 52 can be placed into a selected one of the positioning devices 26 (see FIG. 3) to connect one of the signal terminals 42 electrically with the grounding plate 31. The short contact leg 53 of the conductive member 52 is in electrical contact with the grounding plate 31. The curved long contact leg 54 of the conductive member 52 presses against the curved contact leg 43 of the signal terminal 42, thereby establishing electrical connection therewith. The two prongs 322 of each of the ground terminals 32 extend respectively through the inner longitudinal slots 28 in the positioning seat 21. The two longitudinal rows of the signal terminals 42 extend respectively through the outer longitudinal slots 27 in the positioning seat 23.

With this invention thus explained, it is apparent that numerous modifications and variations can be made without departing from the spirit and scope of this invention. It is therefore intended that this invention be limited only as indicated by the appended claims.

I claim:

1. A ribbon cable connector adapted to establish electrical connection with a ribbon cable and comprising:

an elongated terminal seat;

an elongated clamping frame removably connected to said terminal seat and adapted to claim the ribbon cable between said terminal seat and said clamping frame;

a ground terminal seat including a grounding plate positioned on said terminal seat, and a longitudinal row of ground terminals, which are formed integrally with said grounding plate;

two longitudinal rows of signal terminals positioned on said terminal seat and located on two sides of said row of ground terminals;

a number of positioning devices disposed between said grounding plate and some of said signal terminals; and a plurality of unitary conductive members, each of which is placed within a selected one of said positioning devices and which is in electrical contact with said grounding plate and a corresponding one of said signal terminals, wherein each of said conductive members has a planar plate, a pressed short contact leg, and a curved long contact leg, which project respectively from two sides of said planar plate to connect electrically with said grounding plate and one of said signal terminals, respectively, each of said short contact legs extending obliquely from a corresponding one of said planar plates, each of said signal terminals being formed with a curved contact leg, on which said curved long contact leg of a corresponding one of said conductive members presses.

2. A ribbon cable connector as claimed in claim 1, wherein each of said ground terminals is generally Y-shaped, and has two prongs, which are adapted to be in electrical contact with the ribbon cable and which are offset from each other in a transverse direction of said terminal seat, said terminal seat having a top surface that is formed with two integral longitudinal ribs, said grounding plate of said ground terminal set being disposed between said ribs, said two prongs of each of said ground terminals being supported respectively on said ribs to position said ground terminals on said terminal seat.

3. A ribbon cable connector as claimed in claim 2, further comprising a positioning seat, which is adapted to be clamped between the ribbon cable and said terminal seat and which has two outer longitudinal slots and two inner longitudinal slots that are located between said outer longitudinal slots, said inner and outer longitudinal slots being formed through said positioning seat and being closed at ends thereof, said two prongs of each of said ground terminals extending respectively through said inner longitudinal slots in said positioning seat, said two longitudinal rows of said signal terminals extending respectively through said outer longitudinal slots in said positioning seat.

* * * * *